United States Patent [19]

Davis et al.

[11] 3,975,579

[45] Aug. 17, 1976

[54] CONICAL FACE-SEAL FOR AN ELECTRICAL FEEDTHROUGH

[75] Inventors: Sheridan Davis, Bedford; Donald C. Cheever, Mount Vernon, both of N.H.

[73] Assignee: The United States of America as represented by the Secretary of the Navy, Washington, D.C.

[22] Filed: Dec. 3, 1975

[21] Appl. No.: 637,450

[52] U.S. Cl. ..... 174/18; 29/527.1; 29/592; 174/153 R; 285/161; 339/126 RS

[51] Int. Cl.[2] ..... H01B 17/30

[58] Field of Search ..... 174/18, 50.56, 70 S, 174/151, 152 R, 152 G, 153 R, 153 G; 339/94 A, 126 R, 126 RS, 129, 130 R, 130 C; 29/592, 628, 428, 527.1; 285/161, 192, 334.4; 403/192, 259

[56] References Cited

UNITED STATES PATENTS

| | | | |
|---|---|---|---|
| 2,019,059 | 10/1935 | Sherman | 174/152 R UX |
| 2,145,744 | 1/1939 | Whitney | 174/152 R |
| 2,497,251 | 2/1950 | Wolf | 174/151 |
| 2,651,672 | 9/1953 | Ivanoff | 174/152 R |
| 2,704,357 | 3/1955 | Johnson | 174/151 X |
| 2,838,596 | 6/1958 | Foord | 174/152 R |
| 2,894,055 | 7/1959 | Clarke et al. | 174/18 X |
| 3,033,919 | 5/1962 | Aschinger | 174/151 |
| 3,197,556 | 7/1965 | Simon | 174/153 G |
| 3,660,593 | 5/1972 | Bowles | 174/18 X |

FOREIGN PATENTS OR APPLICATIONS

| | | | |
|---|---|---|---|
| 136,206 | 2/1950 | Australia | 174/153 R |
| 35,334 | 2/1965 | Germany | 174/153 G |
| 1,029,065 | 4/1958 | Germany | 174/151 |

*Primary Examiner*—Laramie E. Askin
*Attorney, Agent, or Firm*—R. S. Sciascia; Robert F. Beers; Sol Sheinbein

[57] ABSTRACT

A face seal for an electrical feedthrough in a bulkhead subject to large differential pressures comprising a metallic bolt routed through a hole in the bulkhead; an electrical conductor soldered to the head of the bolt on the high pressure side of the bulkhead; an epoxy-resin seal molded around and bonded to the protruding head of the bolt and having a conical undersurface mating with the bulkhead so that a thin ring forms the interface between the epoxy seal and the bulkhead; and, a nut screwed on to the threaded end of the bolt on the low pressure side of the bulkhead. The thin ring interface between the epoxy seal and the bulkhead deforms when the epoxy seal is subjected to external pressure so that the seal pressure is amplified.

19 Claims, 2 Drawing Figures

CONICAL FACE-SEAL FOR AN ELECTRICAL FEEDTHROUGH

FIELD OF INVENTION

The present invention relates generally to seals for withstanding high external pressures and more particularly to face seals for an electrical feedthrough into a high pressure bulkhead.

DESCRIPTION OF THE PRIOR ART

Electrical cables must be fed through the hulls of submarine vessels at various points along their lengths. Deep sea cables must be fed through bulkhead housings containing repeaters, equalizers, and other instrumentabilities. All of the aforementioned electrical feedthroughs require bulkhead seals which are impervious to water. In view of the high pressures normally encountered in such deep sea applications the formation of a water-tight seal is difficult. Yet, because of this high pressure, a complete water-seal is a necessity.

Prior art methods for obtaining a proper water-seal have included the use of gland seals and O-Rings to form radial seals around the in-going conductors as they enter the underwater housing. But gland seal and O-ring seals tend to leak when the wire insulation of the conductor begins to cold flow (Under a high steady pressure plastic insulation tends to flow away from the pressure force). This pressure-induced wire shrinkage causes the bond between the wire and the feedthrough body to fail.

A further method of sealing is via potting. But such potting seals frequently fail due to bonding failure and are unserviceable. Potting seals are also subject to pressure-induced wire shrinkage which can peel the wire away from the potting compound unless the potting compound is sufficiently compliant or hydraulic to maintain a compressive stress at the wire-compound interface.

SUMMARY OF THE INVENTION

The present invention solves the sealing problems associated with routing an electrical conductor through a bulkhead which is subject to high differential pressures. The invention comprises inserting a tension means through a hole in the bulkhead so that one end of said tension means protrudes out on the high pressure side of the bulkhead; coupling an electrical conductor through the bulkhead from its high pressure side by way of this bulkhead hole; molding a seal element around and bonding it to the protruding end of the tension means and extending it up around and bonding it to a portion of the electrical conductor, the seal element being shaped to have a conical recess with a suitable included angle around the tension means at the interface with the bulkhead and extending a predetermined distance along the protruding end of the tension means, said seal element being molded from a material with a suitable tensile strength to allow the edges of the conical recess to deform; and, securing the end of the tension means on the low pressure side of the bulkhead so that the seal element is forced against the bulkhead. The seal element, due to its conical recess, has a thin-ring interface with the bulkhead which acts as a pressure amplifier to significantly increase the seal pressure as the pressure differential on the bulkhead is increased.

OBJECTS OF THE INVENTION

An object of the present invention is to securely face-seal an electrical feedthrough into a bulkhead which is subject to high differential pressures.

A further object of the present invention is to amplify the face-seal pressure of an electrical feedthrough into a bulkhead as the pressure differential on the bulkhead is increased.

A yet further object of the present invention is to prevent seal failures on electrical feedthroughs due to insulation cold flow and potting bonding failure.

Other objects, advantages, and novel features of the present invention will become apparent from the following detailed description of the invention when considered in conjunction with the accompanying drawings.

DETAILED DESCRIPTION OF THE INVENTION

Figure 1:
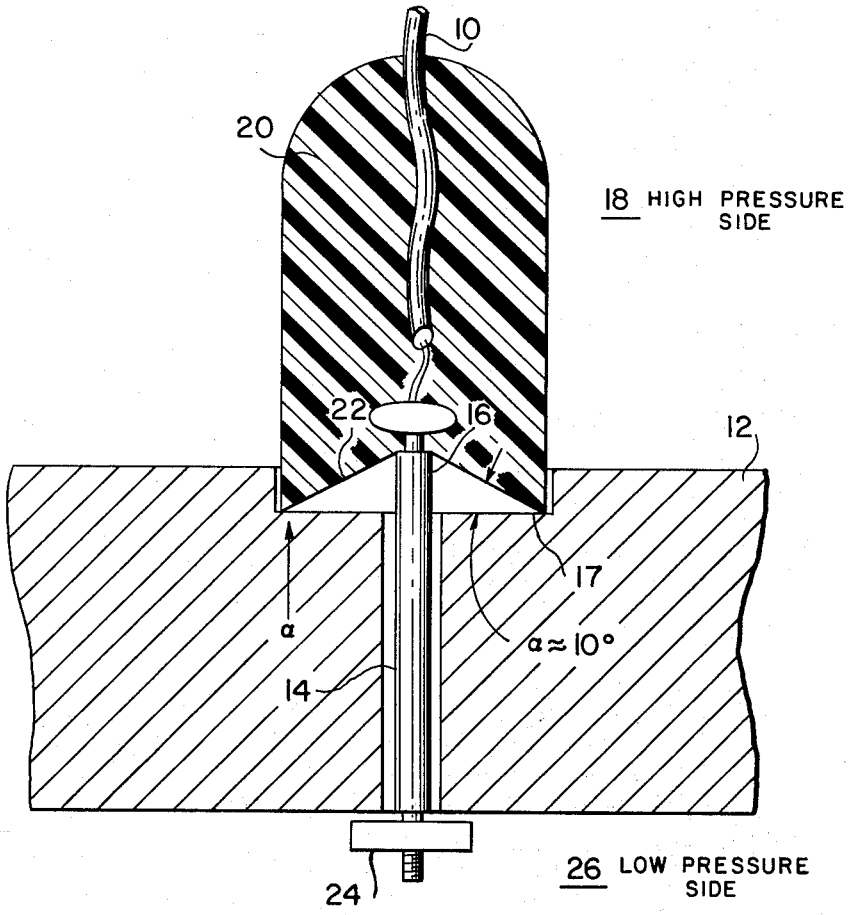
FIG. 1 is a schematic sectioned side view of the face seal of the present invention at a bulkhead feedthrough.

FIG. 1 shows the conical face-seal design of the present invention. An electrical conductor 10 is to be coupled through a bulkhead, hull, or housing 12 which is subject to high differential pressures. To this end a hole is drilled through the bulkhead or housing wall 12 and a tension means 14 inserted therethrough. The tension means 14 has a protruding end 16 on the high pressure side 18 of the bulkhead. An electrical conductor 10 is coupled through the hole in the bulkhead. An epoxy resin seal is then molded around and bonded to the protruding end 16 of the tension means 14. The seal 20 is extended up to envelop a portion of the conductor 10. A conical recess is formed in the undersurface of the epoxy seal around the protruding end 16 of the tension means so that a thin circular ring forms the interface 17 between the epoxy seal 20 and the bulkhead 12. A securing device 24 is adapted to firmly attach the end of the tension means protruding into the low pressure side of the bulkhead to the bulkhead wall.

The tension fastener 14 functions as a preload fastener for the epoxy seal 20. The tension fastener may conveniently take the form of a bolt with one end threaded. The securing device 24 may thus be a threaded nut adapted to be screwed on the end of the bolt. Once the epoxy seal is properly molded around the end 16 of the bolt, the nut 24 may be tightened so that a preload tension is applied through the fastener 14 to the seal 20 forcing it against the bulkhead surface.

It should be noted that the bolt 14 of FIG. 1 need not have a head. The epoxy seal generally provides an extremely reliable bond. A head does provide an advantage though, in that it offers a mechanical interference for the bond. Furthermore, if the head is made larger than the diameter of the hole in the bulkhead 12, then the external pressure load is move evenly distributed to the thin circular seal-bulkhead interface 17.

Although the tension fastener is shown in the drawing as a threaded bolt, various other devices may be utilized to exert a preload downward pressure on the epoxy seal 20. For example, a tightly wound spring with one end attached at the low-pressure side 26 of the bulkhead, and with its other end protruding from the high-pressure side 18 of the bulkhead would be a suitable fastening alternative.

The conductor 10 may be coupled through the bulkhead via the tension fastener 16 as previously mentioned. This may be accomplished in a variety of ways. For example, the conductor may be soldered to the top of the tension fastener as shown in FIG. 1. Of course, the fastener 14 must be metallic in order to implement this coupling technique. The metallic fastener should then be insulated electrically from the bulkhead. Thin-wall fiberglass tubing or heat-shrinkable tubing may be utilized to form a suitable insulating sleeve around the metallic fastener. A dielectric washer may be utilized to isolate the nut 24 from the bulkhead 12.

An alternate method of coupling takes the form of routing the conductor 10 down a hole drilled through the center of the tension fastener. If the hole through the fastener 14 can be made large enough, then a coaxial cable or even a plurality of individual insulated conductors may be routed through the fastener.

A further coupling method comprises running the conductor through the hole in the bulkhead outside of the centrally located fastener 14. But such a coupling technique has the disadvantage in that if the fastener shifts off of center, the conductor insulation and even the conductor itself might be broken. An additional problem arises in routing the conductor or conductors through the securing device 24.

As mentioned previously, the epoxy seal 20 is molded to have a conical recess on its undersurface so that only the outer circular edge of the seal contacts the bulkhead 12. Thus, all of the pressure applied over the epoxy seal area is exerted at this narrow circular-ring contact interface. This effective pressure amplication insures that the contact pressure at the seal mating point exceeds the surrounding ambient pressure thus insuring an effective face-seal.

More specifically, as external pressure is imposed on the epoxy seal, a downward force is developed on the epoxy seal equal in magnitude to the product of the differential pressure of the bulkhead and the piston area of the epoxy seal. Since the face seal is effected at the outer edge of the seal 20, the effective piston diameter is equivalent to the outside diameter of the seal. Application of this piston force on a thin ring causes the outer edges of the conical underface to deform slightly under the deformation stress $\sigma$ so that the thin circular contact area is increased to a circular band. The deformation stress $\sigma$ is equivalent to the sealing pressure. As the external pressure on the bulkhead is increased, the deformed edges of the conical underface are flattened even further thus increasing the deformation stress $\sigma$ even more. Since the deformation stress $\sigma$ and the sealing pressure are equivalent, the sealing pressure likewise increases. To illustrate this amplification with numbers, assume an epoxy seal with a ⅜ inch diameter and a thin circular interface of 0.10 square inches. Then, if 10 pounds per square inch of hydrostatic pressure is applied to the epoxy seal, a force of 100 pounds is exerted on the 0.10 square inch seal area. Thus, the higher the differential pressure goes, the better the seal becomes.

In order to allow the above-discussed deformation, the material used to form the epoxy seal must have a certain amount of flexibility. The actual flexural strength chosen will of course depend upon the pressure environment that the seal must survive. For deep sea applications a flexural strength on the order of 10,000 p.s.i. is found to be appropriate. A preferred epoxy material would also have a specific gravity on the order of 1.12, a water absorption rate of less than 1% in 24 hours, a tensile strength of 7000 p.s.i., a Rockwell hardness of about 100 M, and a resistivity of $9\times10^8$ ohm centimeters. An epoxy found to embody these characteristics is the Scotchcast Resin No. 8 XR5236 made by the Dielectric Materials and Systems Division of the 3M Company. This epoxy resin is especially formulated for molding applications.

The conical recess of the epoxy seal should preferably be filled with a fluid with a very low bulk modulus (highly compressible) such as air so that a sufficient force may be applied to the cone edges to make them deform. If the recess is filled with a liquid, then a chamber and a channel communicating from the chamber to the recess must be added to allow for liquid displacement as the cone edges deform.

it has been found that if the side vertex angles of the conical recess are made large, then, when high pressures are applied to the epoxy seal and the edges 17 of the cone begin to flatten, the walls 22 of the cone-recess may develop severe hoop stresses. If the side vertex angle is too large, the tensile stresses in the hoop direction may exceed the tensile strength of the material and tear it apart. The limits for the included angle, of course, depend on the material used for the seal 20 and on the pressures that are to be applied. In the present embodiment designed for deep sea application and using the aforementioned Scotchcast No. 8 XR 5236 a conservative side vertex angle limit is 10°. Such an angle value also assures maintenance of the mechanical-chemical bond between the epoxy seal and the conductor insulation.

If the epoxy seal 20 is formed at the entrance point of the conductor 10 to have a constrictive fillet 30 (shown in FIG. 2) and if the bulk modulus of the insulation of the conductor 10 and the epoxy seal material are approximately matched, a second advantage is realized from the design. This resides in the fact that as the conductor insulation compresses to a smaller diameter under pressure, the body of the epoxy may compress equally in response to the pressure so that their dimensions remain in the same ratio. This maintenance of the same dimension ratio insures that the conductor-epoxy seal bond does not fail through peeling. In effect, this design provides a good conductor-epoxy seal bond by facilitating the compression of the conductor-seal bond. The fillet 30 increases the constrictive effect of the external pressure on the epoxy material surrounding the conductor, while their matched bulk modules permits them to compress equally. For the present design it is determined that a poly-vinyl chloride conductor insulation with a bulk modulus of 2500 p.s.i. approximates closely the bulk modulus of the aforementioned Scotch-cast No. 8 XR 5236.

Figure 2:
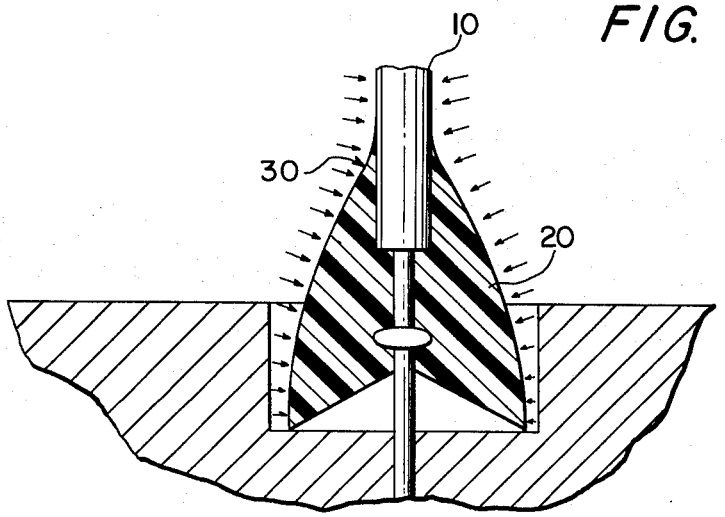
FIG. 2 is a schematic side-view of the face-seal of the present invention illustrating a constrictive fillet.

The FIGS. 1 and 2 show the face seal of the present invention as fitting into a small recess in the bulkhead. Although this recess fit provides protection from lateral blows on the face seal, it is not a critical design feature and may be eliminated.

The disclosed face-seal can be quickly installed, removed, and/or re-installed without degradation. This is due to the fact that only a through hole and a (spot) faced surface are required on the bulkhead. Thus mating requirements for parts are sharply reduced.

External pressure actually increases the seal pressure in this design. This is due to the conical sealing face which acts as a pressure intensifier. With this design the external pressure also increases the strength of the bond between the wire insulation and the epoxy seal, provided that their bulk modules are matched.

This one-piece, moldable, face-seal facilitates electrical connections at great depths in undersea instrument and power applications.

Although the face-seal of the present invention has been disclosed in the context of an electrical feedthrough of a bulkhead, the invention is not limited thereto, but may be used with equal facility for bulkhead hose and piping feedthroughs.

Obviously, many modifications and variations of the present invention are possible in light of the above teachings. It is therefore to be understood that, within the scope of the appended claims, the invention may be practiced otherwise than as specifically described.

What is claimed is:

1. A face-seal for an electrical feedthrough of a housing which is subject to large differential pressures comprising:

tension means extending through a hole in the housing and having one end protruding out on the high pressure side of the housing;

conductor means suitably coupled from the high pressure side of the housing through the housing by way of said tension means so that an electrical signal may be brought into the housing;

epoxy seal means molded around and bonded to the protruding end of said tension means and extending around and bonding to a portion of said conductor means, said epoxy seal means being shaped at the interface with the housing to have a conical recess extending out around the protruding end of said tension means for a predetermined portion of its length, said epoxy seal means being made from a material with suitable flexural strength so that the edge of said conical recess can deform; and means for securing the end of said tension means on the low pressure side of said housing so that said epoxy seal means is forced against said housing;

said epoxy seal means, due to its conical recess, having a thin ring interface with the housing which deforms when subjected to pressure to act as a pressure amplifier to significantly increase the seal pressure as the pressure differential on the housing is increased;

said conical recess having side vertex angles sufficiently small to prevent tensile stresses in the hoop direction induced in said epoxy seal means when subjected to pressure from exceeding the tensile strength of said epoxy seal means.

2. A face-seal for an electrical feedthrough as defined in claim 1, wherein the protruding end of said tension means has an enlarged head.

3. A face-seal for an electrical feedthrough as defined in claim 1, wherein said tension means comprises a metallic rod which is threaded at the end on the low pressure side of said housing, and wherein said securing means comprises a nut screwed onto said threaded end of said tension means.

4. A face-seal for an electrical feedthrough as defined in claim 1, wherein the side vertex angles of said conical recess are not greater than 10°.

5. A face-seal for an electrical feedthrough as defined in claim 1, wherein said tension means is an electrical conductor; and, said conductor means is conductively attached thereto.

6. A face-seal for an electrical feedthrough as defined in claim 1, wherein said conductor means couples through said housing by routing said conductor means through a hole in the center of said tension means.

7. A face-seal for an electrical feedthrough as defined in claim 1, wherein said conductive means enters said epoxy seal means through a constrictive fillet.

8. A face-seal for an electrical feedthrough as defined in claim 7 further comprising:

insulation concentrically arranged around the exterior of said conductor means along its entire length, wherein the bulk modulus of said epoxy seal means is approximately matched to the bulk modulus of said insulation means whereby the ratio of the dimensions of said epoxy seal means to said insulation means will remain the same under pressure.

9. A method for sealing an electrical feedthrough into a housing which is subject to large differential pressure comprising the steps of:

inserting a tension means through a hole in the housing so that one end protrudes out on the high pressure side of the housing;

coupling an electrical conductor through the housing from its high pressure side by way of the hole in said housing;

molding an epoxy seal around and bonding it to the protruding end of said tension means and extending it around annd bonding it to a portion of said electrical conductor, said epoxy seal being molded at its underface adjacent to said housing to have a conical recess extending around the protruding end of said tension means for a predetermined portion of its length, said epoxy seal being made from a material with a suitable flexural strength so that the edges of the conical recess can deform; and securing the end of said tension means on the low pressure side of the housing so that said epoxy seal is forced against the housing;

said epoxy seal, due to its conical recess, having a thin ring interface with the housing which deforms when subjected to pressure to act as a pressure amplifier to significantly increase the seal pressure as the pressure differential on the housing increases, said conical recess being molded with an included angle sufficiently small to prevent tensile stresses in the hoop direction induced in said epoxy seal when subjected to pressure from exceeding the tensile strength of said epoxy seal.

10. A method for sealing an electrical feedthrough into a housing as defined in claim 9, wherein said step of securing comprises the step of:

screwing a nut on to the end of said tension means on the low pressure side of the housing.

11. A method for sealing an electrical feedthrough into a housing as defined in claim 9, wherein said step of molding comprises the step of: molding said conical recess with an included angle of not greater than 10 degrees.

12. A method of sealing an electrical feedthrough into a housing as defined in claim 9, wherein said step of coupling comprises the step of: bonding the electrical conductor to the protruding end of said tension means.

13. A method for sealing an electrical feedthrough as defined in claim 9, wherein said step of coupling comprises the step of: routing said electrical conductor through the center of said tension means.

14. A face-seal for a feedthrough into a bulkhead which is subject to large differential pressures comprising:

feedthrough means extending through a hole in said bulkhead and having one end protruding out on the high pressure side of said bulkhead and having its other end secured at the low pressure side of said bulkhead; and epoxy seal means with a conical undersurface mating with said bulkhead at the point where said feedthrough means protrudes on said high pressure side of said bulkhead, said seal means being molded around and bonded to said protruding end of said feedthrough means;

said seal means, due to its conical undersurface, having a thin ring interface with said bulkhead which deforms when subject to external pressure so that the seal pressure is amplified, said conical recess having side vertex angles sufficiently small to prevent tensile stresses in the hoop direction induced in said epoxy seal when subjected to pressure from exceeding the tensile strength of said epoxy seal.

15. A face-seal for a feedthrough as defined in claim 14, wherein the protruding end of said feedthrough means has an enlarged head.

16. A face-seal for a feedthrough as defined in claim 14, wherein said feedthrough comprises:

metallic rod means which is threaded at the end on the low pressure side of said bulkhead; and nut means screwed onto said threaded end of said rod means.

17. A face-seal for a feedthrough as defined in claim 14, wherein said epoxy seal means is made from an epoxy resin with a flexural strength on the order of 10000 p.s.i.

18. A face-seal for a feedthrough as defined in claim 14, wherein said conical undersurface of said epoxy seal means has side vertex angles not larger than 10°.

19. A face-seal for an electrical feedthrough as defined in claim 1 wherein the cavity formed by said conical recess and said housing is filled with a highly compressible fluid.

* * * * *